United States Patent [19]

Schleimer et al.

[11] Patent Number: 4,603,810

[45] Date of Patent: Aug. 5, 1986

[54] METHOD AND APPARATUS FOR THE ACCELERATION OF SOLID PARTICLES ENTRAINED IN A CARRIER GAS

[75] Inventors: Francois Schleimer; Clement Burton; André Bock; Jean Peckels, all of Esch, Luxembourg

[73] Assignee: Arbed S.A., Luxembourg, Luxembourg

[21] Appl. No.: 587,540

[22] Filed: Mar. 8, 1984

[30] Foreign Application Priority Data

Mar. 11, 1983 [LU] Luxembourg ..... 84686

[51] Int. Cl.[4] ..... C21B 7/16; C21C 5/32

[52] U.S. Cl. ..... 239/1; 239/589; 266/225; 266/266; 406/154; 406/195

[58] Field of Search ..... 406/154, 194, 195; 239/1, 589; 51/439; 266/225, 266

[56] References Cited

U.S. PATENT DOCUMENTS

| | | | |
|---|---|---|---|
| 871,208 | 11/1907 | Cotton | 51/439 X |
| 2,175,160 | 10/1939 | Zobel et al. | 239/589 |
| 2,310,265 | 2/1943 | Sweeny | 406/194 |
| 3,957,258 | 5/1976 | Carlomagno et al. | 266/225 |
| 4,038,786 | 8/1977 | Fong | 51/439 X |

FOREIGN PATENT DOCUMENTS

| | | | |
|---|---|---|---|
| 571082 | 9/1958 | Belgium | 239/589 |

*Primary Examiner*—Jeffrey V. Nase
*Attorney, Agent, or Firm*—Fishman & Dionne

[57] ABSTRACT

A method and apparatus for accelerating solid particles entrained in a carrier gas so as to maximize the velocity of the particles at the output end of a duct is presented. This maximized or optimal acceleration is achieved by varying the cross section of the duct over at least the last 5 meters upstream from the opening thereof. Preferrably, the cross section of the duct should continuously increase i.e. diverge, towards the opening. This diverging cross section is preferrably in accordance with a nonlinear function of the length.

16 Claims, 5 Drawing Figures

METHOD AND APPARATUS FOR THE ACCELERATION OF SOLID PARTICLES ENTRAINED IN A CARRIER GAS

BACKGROUND OF THE INVENTION

This invention relates to a method and apparatus for accelerating the flow of solid particles entrained in a carrier gas. The method and apparatus for accelerating solid particles in a carrier gas in accordance with the present invention is particularly well suited for use during recarburization of a metal melt in, for example, the refining of iron into steel.

It is well known that the amount of scrap or other cooling additives which are incorporated into a metal melt during refining by the LD, LBE, and other known processes, substantially depends upon the composition of the melt, the temperature of the batch, and the thermodynamic progression of the refining operation. Typically, the consumption of scrap per ton of liquid melt is approximately 300 kg during the conversion of lean melt, and approximately 400 kg for a phosphorous melt. The overall costs of making steel can be reduced by incorporating proportionally larger amounts of scrap into the melt during the refining processes. Thus, in order to reduce the cost of steel, it is desirable to increase the above discussed proportional amounts of additives i.e., scrap.

One known method of proportionally enlarging the amount of scrap material utilized during refining consists of increasing the degree of postcombustion of the carbon monoxide (CO) evolving from the pool so that the pool or melt will absorb a maximum amount of heat liberated from the scrap. Another prior art method for the efficient utilization of scrap comprises heating the metal pool using supplemental sources of energy. Such energy sources include gas and/or liguid fuels and have been associated with variable success. Alternatively, the supplemental energy sources may comprise adding combustible material in the form of granules of carbonaceous material. Using this technique, carbonaceous materials are incorporated into the bottom of the pool through glass pipes or permeable elements located in the bottom of the converter, or from the top, together with a carrier gas.

It will be appreciated that the addition of scrap and other additives for reducing the cost of producing steel may be made either before blasting or after a first phase of blasting.

Luxembourg Patent Application No. LU 84,444, corresponding to U.S. patent application Ser. No. 544,073, now U.S. Pat. No. 4,519,587 which is assigned to the assignee hereof and incorporated herein by reference, describes a system for delivering solid carbonaceous fuel materials from a blowing lance to a metal pool. The apparatus described therein essentially comprises at least one nonoxidizing compressed gas source, a circuit which supplies granulated carbonaceous material suspended in a carrier gas, at least one circuit which supplies flushing gas, various means for metering different flow rates of the gas and solid particulate streams and means for separately or jointly connected the above described circuits to appropriate conduits which terminate in a blowing lance. In order to achieve adequate absorption of the carbonaceous material by the metal melt, it has been found necessary to ensure that the melt not only have predetermined concentrations of oxygen and carbon, but that the pool also have enough carbonaceous material so as to provide adequate kinetic energy at the output of the lance to effect penetration thereof into the melt. This elevated or high kinetic energy, which is also required in order to avoid premature combustion of the carbonaceous material above the pool, is obtained by the use of a powerful flow of carrier gas. In view of the fact that this jet of gas exerts an undesirable cooling effect, it will be appreciated that the desired quantity of carbonaceous material delivered to the pool must utilize a minimum of carrier gas.

It will be appreciated that in constructing and installing a device used to deliver carbonaceous material into a melt, the limitations of existing equipment must be taken into account. For example, the source of gas to which other devices are added may be an important factor. Also, the lengths of the ducts often control the placement of the cellular regulator and the lance-supporting carriage. Moreover, the lance heads and the lance-supporting carriages may not permit exceeding certain duct diameter in view of dimensioning weight and factors.

Particle size distribution of the carbon material must also be considered in constructing and installing such a delivery device. It is well known, for example, that very fine grains of carbonaceous materials have a tendency to stick together. Experiments have shown that this sticking is due to low kinetic energy at the outlet of the lance. Conversely, relatively larger grains of carbonaceous material have a higher inertia, and the carrier gas will not accelerate the larger grains over a short distance to a desired speed. Moreover, the dimensional configuration of the grains is also of great importance as far as abrasion problems with the ducts are concerned. Further, the nature of the carbonaceous material and the effects of impurities (i.e, humidity, volatile substances) on the combustion in the pool, as well as in the metal batch (i.e., sulfur) are all equally important factors in designing and constructing solid particle delivery devices of the type hereinabove discussed.

SUMMARY OF THE INVENTION

The above discussed and other problems of the prior art are overcome or alleviated by the device for accelerating solid particles of the present invention. In accordance with the present invention, an acceleration device which is capable of delivering a jet of concentrated granular material at as high a velocity as possible, and which is capable of being integrated easily into existing equipment is presented. The apparatus of the present invention comprises a feed duct for gas/solid particle mixtures having a cross section which changes at least 5 meters upstream from the opening thereof. In a preferred embodiment, the cross section of the duct increases continuously toward the opening of the blowing lance. Preferably, the cross section increases according to a nonlinear system of equations as a function of the length. In another preferred embodiment, the cross section of the duct diverges, initially by at least 30% of its initial value, and then increases continuously towards the opening of the lance. This increase should be in accordance with the set of equations discussed above. In still another preferred embodiment of the present invention, the variation of the cross section of the duct is interrupted by areas in which the cross section of the duct remains constant.

The above discussed and other advantages of the present invention will be apparent to and understood by those skilled in the art from the following detailed description and drawings.

BRIEF DESCRIPTION OF THE DRAWINGS

Referring now to the drawings wherein like elements are numbered alike in the several Figures.

DESCRIPTION OF THE PREFERRED EMBODIMENT

Figure 1:
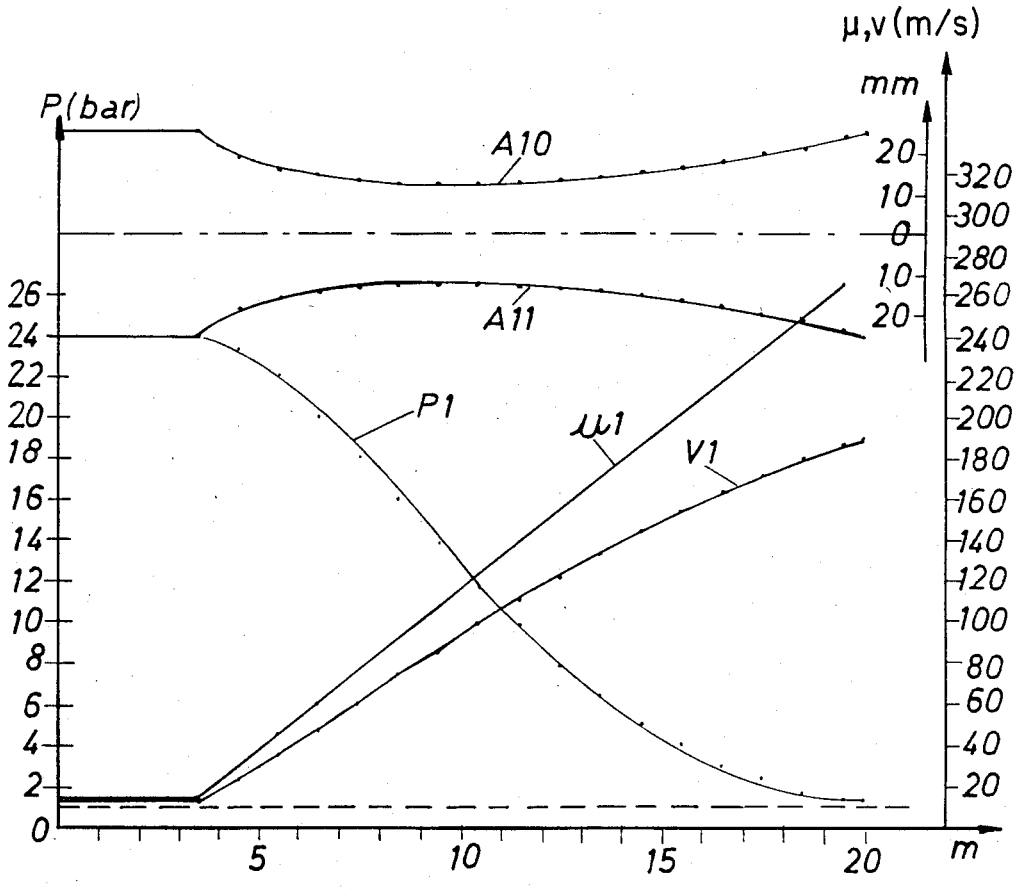
FIG. 1 is a graphical representation of a duct having a varying cross section, and the effect of that cross section on the velocity of the gas, the velocity of the particles, and the pressure, as a function of the longitudinal dimension of the duct near the opening.

The discoveries of the present invention result from a plurality of tests made on lances of different dimensions, having been supplied with varying gas pressures and varying gas/solid particle mixtures. It has been found that a jet of solid particles leaving a blowing lance becomes more concentrated, and the speed of those particles increases, if the static pressure of the gas/particle mixture approaches atmospheric pressure (1 bar) at the opening of the lance. It has further been found, that the value of 1 bar pressure is preferrable in achieving optimal results. If the pressure at the end of the blowing lance becomes lower, the duct may be obstructed; and if the pressure becomes higher, the particles may disperse at the output of the lance thereby diminishing the effect of the particles impact on the melt.

It should be appreciated that the forces producing the acceleration of the solid particles depend upon the relative velocities of the carrier gas and the particles. Accordingly, the maximum velocity that the solid carbonaceous material can reach is equal to that of the velocity of the carrier gas. Thus, as high a gas velocity as possible should be utilized in order to maxmize the velocity of the solid particles. It has been determined that the frictional forces between the carrier gases and the particles diminish considerably (assuming the particles are spherical) for gas velocities near a critical Reynolds number corresponding approximately to the sonic velocity of the carrier gas. Unfortunately, the local creation of supersonic velocities of gas, for example using Laval blast pipes, will not lead to favorable or desirable results. In fact, the supersonic velocity of the gas lasts only for a short distance downstream from the constriction of the blast pipe, so that it is impossible to transfer this high velocity of the carrier gases to the solid particles.

In view of the above remarks, in order to transfer a maximum velocity to the solid particles at the output of the pipe or blowing lance, at an acceptable efficiency or yield, it will be necessary to reach a sonic velocity of carrier gas at the opening or near the opening of the blast pipe (versus reaching the sonic velocity upstream from the opening of the blast pipe). Similarly, in order to have a fine jet of carbonaceous material at the output of the lance, it will be necessary for the static pressure of the jet at the output of the lance to be as close to atmospheric pressure as possible. In sum, in order to achieve optimal results, sonic velocity of the carrier gas along with static pressure thereof should be achieved at the output of the blowing lance.

Experimentation has confirmed theoretical calculations based on an isothermal expansion of the gas and has showed that at a given pressure and nominal flow rate of the gas source, it is necessary to provide a relatively short duct if it is desired to have a higher nominal flow rate of carbon. Moreover, the shorter the duct, the greater the differences between the velocities of the carrier gas and of the particles at the opening of the lance. In prior teachings, it had been determined that to obtain acceptable particle velocities, it was necessary to provide prohibitively long lengths of duct.

The following Examples trace the development leading to the present invention as well as citing specific examples thereof.

EXAMPLE 1

A source of carrier gas capable of supplying 2300 cubic meters per hour (standard) of gas at a pressure of 16 bars is utilized. In order to have a flow rate of gas of 2300 cubic meters per hour (standard), when the gas leaves the duct at a velocity close to that of sound, it is necessary to provide a duct diameter of approximately 50 mm. The density of the carbon is 867 kg per cubic meter, and the average grain size is 5 mm.

An optimal flow rate of carbon of 400 kg per minute under the above conditions provides a velocity of carbon particles of approximately 120 meters per second and requires a total duct length of 60 meters.

An optimal flow rate of carbon of 300 kg per minute under the above experimental conditions provides a velocity of carbon particles of approximately 140 meters per second for a total duct length of 90 meters.

In view of the above results, it has been found that there is a substantial difference between the velocities of the gas and of the particles at the opening of the lance of approximately 320 meters per second, and that the duct lengths to be provided become larger when higher particle velocities are desired.

The results of the above example are somewhat undesirable and as a consequence, the inventors herein have attempted to reduce the difference between the velocities of the gas and of the particles at the opening of the lance without having to use excessive lengths of duct. Accordingly, a study of the velocities and pressures over the 10 meters of duct upstream from the opening of the lance have been conducted. It has been discovered that the pressure of the carrier gas drops by approximately $\frac{1}{3}$ of its nominal value to atmospheric pressure, and that the velocity of the gas rises in a quasi-exponential manner while the velocity of the particles only doubles.

EXAMPLE 2

Using the identical conditions as in example 1, and in view of the just discussed discoveries relating to the final 10 meters of the duct, the following results were achieved:

For a total duct length of 60 meters and a flow rate of carbon of 400 kg per minute, the velocities of the gas and other particles were found to be 85 meters per second and 70 meters per second respectively, after a distance traveled of approximately 50 meters.

For a total duct length of 90 meters and a flow rate of carbon of 300 kg per minute, the velocities of the gas and the particles were found to be 80 meters per second and 65 meters per second respectively, after a distance traveled of approximately 80 meters.

In order to obtain a less abrupt increase in the velocity of the gas over the last few meters of the duct (a velocity which obviously cannot be transmitted to the solid particles over that short a distance), experiments have been conducted with ducts having a variable cross section near the opening thereof.

EXAMPLE 3

Initial experiments utilized a duct having a cross section at the opening thereof of 5.0 cm in diameter which was identical with the cross sectional diameter used in the test described hereinabove. The duct continuously diverged up to a constriction point located 10 meters downstream from the opening whereupon the diameter was reduced to 2.8 cm. The loss in pressure caused by this constriction was compensated by an increase of the carrier gas source pressure to 25 bars. Compared to a duct of uniform cross section supplied with a pressure of 25 bars, the relative increase in the velocity of the particles was increased by 60% (the flow rate of the carbon was 300 kg per minute and the lengths of the ducts 50 meters in both cases).

EXAMPLE 4

Unfortunately, the constriction used in Example 3 provides a number of problems including very heavy wear as well as a reduction in the flow rate of the carbon. Accordingly, in order to avoid use of a constriction, other experiments have utilized a duct which widens continuously i.e. diverges, over approximately 20 meters from the normal constant cross section of the duct. Thus, from a diameter equal to about 5 cm, the cross sectional diameter diverges towards the opening up to approximately 8 cm. In order to achieve a pressure close to atmospheric pressure near the opening of the duct, the flow rate of the gas must be at least twice the flow rate used for a duct having a constant diameter of 5 cm. In this example, an increase in the velocity of the particles of 60% relative to that observed for a duct with constant cross section was found. A flow rate of carbon of 500 kg per minute and an overall length of duct of 50 meters was used for this particular example.

EXAMPLE 5

Because of the favorable effects of a variable cross section on the final velocity of the solid particles as clearly shown in the above examples, further experiments utilizing ducts with plural variations in cross section were conducted. FIGS. 1 through 4 show two examples of duct sections (A10, A11 and A20, A21 respectively) having variations in cross sectional diameter which are not proportional to the length of the duct. The figures also show the variations in the velocity of the gas (U1 and U2 respectively), variations in the velocity of the particles (V1 and V2 respectively), and the variations in the pressure (P1 and P2 respectively) as a function of the linear dimension of the duct near the opening thereof.

Figure 3:
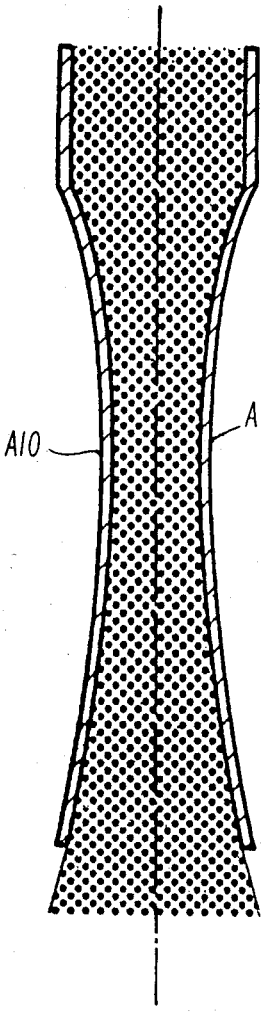
FIG. 3 is a cross sectional elevation view of the duct graphically shown in FIG. 1.

Referring first to FIGS. 1 and 3, a duct having a diameter of from 5 cm down to about 3.5 cm is shown. In FIG. 1 (and FIG. 3), the diameter of the 5 cm duct is initially decreased to about 3.5 cm (converges) before it is increased (diverges) up to a diameter of 5 cm over a length of about 20 meters. It has been found that the length of the duct upstream from the constriction contributes only slightly to the overall acceleration of the solid particles. In fact, it has been found that the solid particles acquire pratically all of their velocity V1 over the last 20 meters upstream from the opening of the duct. It has also been found that the increase in velocity of the carrier gas is no longer quasi-exponential as resulted in the prior examples. Thus, with reference to FIG. 1, the velocity of the particles tends towards a level of approximately 210 meters per second.

EXAMPLE 6

Figure 2:
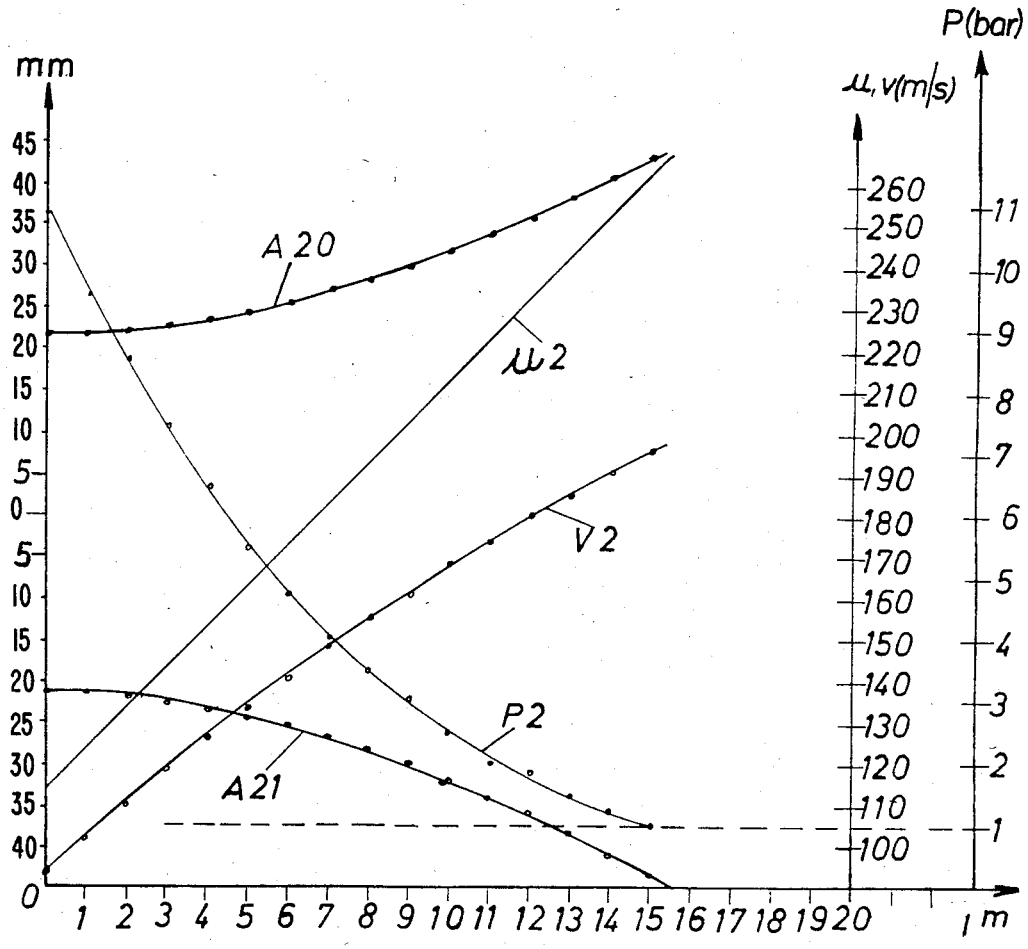
FIG. 2 is a graphical representation, similar to FIG. 1, but showing a duct having a different cross sectional variation.
Figure 4:
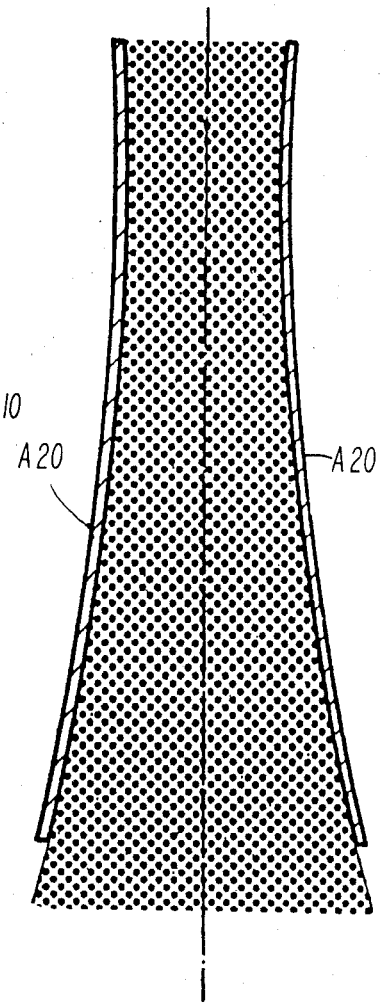
FIG. 4 is a cross sectional elevational view of the duct graphically shown in FIG. 2.

Referring now to FIGS. 2 and 4, the duct shown therein has a diameter which diverges initially from about 4.7 cm to about 8.7 cm at the opening thereof over a distance of 15.5 meters. The velocity of the particles V2 undergo a substantially linear increase to about 195 meters per second at the opening of the duct.

It has been discovered that when the accelerating device in accordance with the present invention comprises a duct having a cross section which increases i.e., diverges, over at least 5 meters upstream from the opening thereof, it is possible to accelerate the solid particle material to velocities approaching those of the carrier gas. These highly desirable results are achieved not withstanding the fact that conduits or ducts of up to 90 meters long do not have to be used in order to obtain these appreciable particle velocities. Moreover, the selective use of constrictions permit limiting the dimensions of the duct at the opening thereof, limiting the wear from abrasion upstream from the constriction, and permits easy integration of the divergent section of the duct into prior art known lance head configurations. It will be appreciated that solid particles may be introduced into the molten bath using autonomous lances, independent of the lances which supply the oxygen, and which have their own cooling circuits and their own supporting carriages.

In a preferred embodiment of the present invention, the continuously increasing duct diameter i.e., divergent diameter, will increase according to a nonlinear function of the overall duct length. This nonlinear functional length can be reduced to a system of differential equations as set forth below:

$$\text{Initial condition: } u(x) = f(x \text{ given, for example, linear}) \tag{0}$$

$$\frac{dp(x)}{dx} = \frac{pg(x)\cdot\rho_o}{2p_o}\cdot\left[\frac{\lambda\cdot u^2(x)}{d(x)} + \frac{k\cdot 2\cdot Ac(x)}{Ag(x)}\cdot(u(x)-V(x))^{\nu}\right] \tag{1}$$

$$\frac{dv(x)}{dx} = \frac{3\cdot C_D\cdot\rho g(x)\cdot(u(x)-v(x))^2}{4\cdot\rho c\cdot d_c\cdot v(x)} \tag{2}$$

$$d(x) = \sqrt{\frac{Q_c}{\dfrac{60\cdot u(x)\cdot p(x)\cdot\rho c\cdot v(x) + Q_N\cdot P_o}{900\cdot u(x)\cdot p(x)\cdot 3.1416}}} \tag{3}$$

wherein:

u(x) = velocity of the gas at the point x of the duct v(x) = velocity of the particles at the point x of the duct p(x) = pressure of the gas at the point x of the duct $p_o$ = atmospheric pressure pg(x)=gas/wall friction at the point x of the duct
d(x)=diameter of the duct at the point x of the duct
k,$\nu$=factors deduced by theoretical calculation (0.025 and 1.2)
Ac(x)=area occupied by the particles in a section at the point x of the duct
Ag(x)=area occupied by the gas in the same section
$C_D$=coefficient induced resistance
$\rho_g(x)$=density of the gas at point x of the duct
$\rho_o$=density of the gas at the opening (i.e. atmospheric pressure)
$\rho_c$=specific weight of the particles
$d_c$=diameter of the particle assumed to be spherical
$Q_c$=flow rate of the particles (kg/min)
$Q_N$=flow rate of the gas ($m^3$/h) (standard)
$\lambda$=gas/wall coefficient of friction In an alternative embodiment of the present invention wherein a constriction such as shown in example 5 is employed, preferrably, the converging cross section of the duct should diminish by at least 30% relative to the initial value of the diameter, and then diverge continuously towards the opening thereof. As in the previously discussed embodiment, the final diverging section of the duct should preferably increase in accordance with the nonlinear equations (0)–(3) set forth hereinabove.

Figure 5:
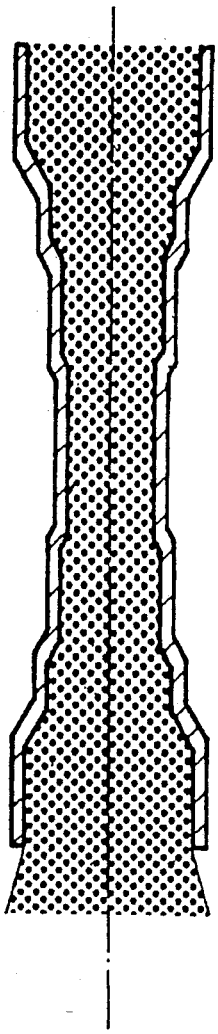
FIG. 5 is a cross sectional elevation view of a duct having selectively interrupted areas of constant cross section in accordance with the present invention.

In yet another embodiment of the present invention shown in FIG. 5, the variations in the cross sectional diameter of the duct should be interrupted at appropriate intervals by areas in which the cross section of the duct remains constant. In this way, the particular dimensional configurations and changes in cross section may be specifically tailored for a plurality of different factors and conditions.

It should be understood that while the invention has been described relative to specific problems found in the refining of iron melts, other applications of the present invention should be equally obvious to those skilled in the art. For example, the present invention is well suited for sand blasting wherein there is a need for solid particles having high velocities and wherein a variable duct cross section such as that described hereinabove would be capable of providing those desired velocities. Thus, the present invention is well suited for any application wherein solid particles having a high velocity over a short distance are needed.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for accelerating solid particles entrained in a carrier gas through a duct, the carrier gas flowing at subsonic speeds, said duct including exit section means terminating at an opening, the interior cross-section of said exit section means varying from a nominal value to a larger value over at least about 5 meters upstream from said opening whereby the subsonic velocity of said carrier gas increases at an approximately linear rate and whereby the velocity of said solid particles substantially approaches the velocity of said carrier gas at said opening.

2. The device of claim 1 wherein said exit section means of said duct has a divergent cross-section over at least about 5 meters upstream from said opening.

3. The device of claim 2 wherein:

said exit section means diverges in accordance with a nonlinear function of the length of said duct.

4. The device of claim 1 wherein:

said exit section means of said duct has an initially converging cross-section to a constriction point whereupon said exit section means cross-section diverges to said opening.

5. The device of claim 4 wherein:

said exit section means cross-section converges to at least 30% of the nominal cross-section.

6. The device of claim 5 wherein:

said exit section means diverges in accordance with a nonlinear function of the length of said duct.

7. The device of claims 3 or 6 wherein said nonlinear function is defined by the equations:

$$\text{Initial condition: } u(x) = f(x \text{ given, for example, linear}) \quad (0)$$

$$\frac{dp(x)}{dx} = \frac{pg(x)\cdot\rho_o}{2p_o}\cdot\left[\frac{\lambda\cdot u^2(x)}{d(x)} + \frac{k\cdot 2\cdot Ac(x)}{Ag(x)}\cdot(u(x)-V(x))^{\nu}\right] \quad (1)$$

$$\frac{dv(x)}{dx} = \frac{3\cdot C_D\cdot\rho g(x)\cdot(u(x)-v(x))^2}{4\cdot\rho c\cdot d_c\cdot v(x)} \quad (2)$$

$$d(x) = \sqrt{\frac{Q_c}{\dfrac{60\cdot u(x)\cdot p(x)\cdot\rho c\cdot v(x) + Q_N\cdot P_o}{900\cdot u(x)\cdot p(x)\cdot 3.1416}}} \quad (3)$$

wherein:

u(x)=velocity of the gas at the point x of the duct
v(x)=velocity of the particles at the point x of the duct
p(x)=pressure of the gas at the point x of the duct
$p_O$=atmospheric pressure
pg(x)=gas/wall friction at the point x of the duct
d(x)=diameter of the duct at the point x of the duct
k,$\nu$=factors deduced by theoretical calculation (0.025 and 1.2)
Ac(x)=area occupied by the particles in a section at the point x of the duct
Ag(x)=area occupied by the gas in the same section
$C_D$=coefficient induced resistance
$\rho_g(x)$=density of the gas at point x of the duct
$\rho_o$=density of the gas at the opening (i.e. atmospheric pressure)
$\rho_c$=specific weight of the particles
$d_c$=diameter of the particle assumed to be spherical
$Q_c$=flow rate of the particles (kg/min)
$Q_n$=flow rate of the gas ($m_3$/h) (standard)
$\lambda$=gas/wall coefficient of friction.

8. The device of claim 1 wherein:

said varying cross-section of said duct is selectively interrupted by cross-sectional areas of constant cross-section over at least about 5 meters upstream from said opening.

9. A method for accelerating solid particles entrained in a carrier gas through a duct, the carrier gas flowing at subsonic speeds, the duct including an exit section terminating an an opening, the method comprising the steps of:

varying the interior cross-section of said exit section from a nominal value to a larger value over at least about 5 meters upstream from said opening; and delivering the solid particles entrained in the carrier gas flowing at subsonic speeds through said exit section whereby the subsonic velocity of said carrier gas increases at an approximately linear rate and whereby the velocity of said solid particles substantially approaches the velocity of said carrier gas at said opening.

10. The method of claim 9 wherein said exit section of said duct has a divergent cross-section over at least about 5 meters upstream from said opening.

11. The device of claim 10 wherein:

said exit section diverges in accordance with a nonlinear function of the length of said duct.

12. The method of claim 9 wherein:

said exit section of said duct has an initially converging cross-section to a constriction point whereupon said exit section cross-section diverges to said opening.

13. The method of claim 12 wherein:

said exit section cross-section converges to at least 30% of the nominal cross-section.

14. The method of claim 12 wherein:

said exit section diverges in accordance with a nonlinear function of the length of said duct.

15. The method of claims 11 or 14 wherein said nonlinear function is defined by he equations:

$$\text{Initial condition: } u(x) = f(x \text{ given, for example, linear}) \quad (0)$$

$$\frac{dp(x)}{dx} = \frac{pg(x) \cdot \rho_o}{2p_o} \cdot \left[ \frac{\lambda \cdot u^2(x)}{d(x)} + \frac{k \cdot 2 \cdot Ac(x)}{Ag(x)} \cdot (u(x) - V(x))^{\nu} \right] \quad (1)$$

-continued $$\frac{dv(x)}{dx} = \frac{3 \cdot C_D \cdot \rho g(x) \cdot (u(x) - v(x))^2}{4 \cdot \rho c \cdot d_c \cdot v(x)} \quad (2)$$

$$d(x) = \sqrt{\frac{Q_c}{\dfrac{60 \cdot u(x) \cdot p(x) \cdot \rho c \cdot v(x) + Q_N \cdot P_o}{900 \cdot u(x) \cdot p(x) \cdot 3.1416}}} \quad (3)$$

wherein:

u(x)=velocity of the gas at the point x of the duct v(x)=velocity of the particles at the point x of the duct p(x)=pressure of the gas at the point x of the duct $p_O$=atmospheric pressure pg(x)=gas/wall friction at the point x of the duct d(x)=diameter of the duct at the point x of the duct k,$\nu$=factors deduced by theoretical calculation (0.025 and 1.2)

Ac(x)=area occupied by the particles in a section at the point x of the duct

Ag(x)=area occupied by the gas in the same section $C_D$=coefficient induced resistance $\rho_g(x)$=density of the gas at point x of the duct $\rho_o$=density of the gas at the opening (i.e. atmospheric pressure)

$\rho_c$=specific weight of the particles $d_c$=diameter of the particle assumed to be spherical $Q_c$=flow rate of the particles (kg/min)

$Q_n$=flow rate of the gas ($m^3$/h) (standard)

$\lambda$=gas/wall coefficient of friction.

16. The method of claim 9 wherein:

said varying cross-section of said duct is selectively interrupted by cross-sectional areas of contant cross-section over at last about 5 meters from said opening.

* * * * *